US010206488B2

(12) United States Patent
Groppfeldt

(10) Patent No.: US 10,206,488 B2
(45) Date of Patent: Feb. 19, 2019

(54) CARRIER FRAME FOR A RUCKSACK OR EQUIVALENT

(71) Applicant: Rune Groppfeldt, Oslo (NO)

(72) Inventor: Rune Groppfeldt, Oslo (NO)

( * ) Notice: Subject to any disclaimer, the term of this patent is extended or adjusted under 35 U.S.C. 154(b) by 0 days.

(21) Appl. No.: 15/574,959

(22) PCT Filed: May 23, 2016

(86) PCT No.: PCT/EP2016/061572

§ 371 (c)(1),
(2) Date: Nov. 17, 2017

(87) PCT Pub. No.: WO2016/188953

PCT Pub. Date: Dec. 1, 2016

(65) Prior Publication Data

US 2018/0168322 A1 Jun. 21, 2018

(30) Foreign Application Priority Data

May 25, 2015 (SE) ..... 1530075

(51) Int. Cl.
*A45F 3/08* (2006.01)
*A45F 3/12* (2006.01)
*A45F 3/10* (2006.01)

(52) U.S. Cl.
CPC . *A45F 3/08* (2013.01); *A45F 3/10* (2013.01)

(58) Field of Classification Search
CPC ..... A45F 3/08; A45F 2003/045; A45F 3/04
USPC ..... 224/265, 637, 634
See application file for complete search history.

(56) References Cited

U.S. PATENT DOCUMENTS 3,282,483 A * 11/1966 Babcock ..... A45F 3/10 224/262
3,504,377 A * 4/1970 Biggs, Jr. ..... A63B 71/12 2/460
4,114,788 A * 9/1978 Zufich ..... A45F 3/08 224/153

(Continued)

FOREIGN PATENT DOCUMENTS

EP 1842449 A1 10/2007
KR 10-1494189 B1 2/2015

OTHER PUBLICATIONS

International Search Report and Written Opinion issued in PCT Application No. PCT/EP2016/061572 dated Aug. 3, 2016 (eight (8) pages).

(Continued)

*Primary Examiner* — Adam Waggenspack
(74) *Attorney, Agent, or Firm* — Olive Law Group, PLLC

(57) ABSTRACT

The invention relates to a carrier frame for a load in the form of a rucksack or equivalent comprising a hip frame which is more rigid in the vertical direction than in the horizontal direction and a pair of chest frames. The hip frame is designed to be applied around the user's hips in order to transfer loads to the carrier's hip region. The chest frames extend from the hip frame upwards in front of the user's body and are fully or partially in contact with the user's chest area, below the user's collar bone but above the user's waist. The chest frames are each provided with a chest plate in order to distribute the pressure over a greater area when applied to the user's chest area and to reduce the pressure per unit area on the user's chest.

14 Claims, 10 Drawing Sheets

(56) References Cited

U.S. PATENT DOCUMENTS

Figure 1:
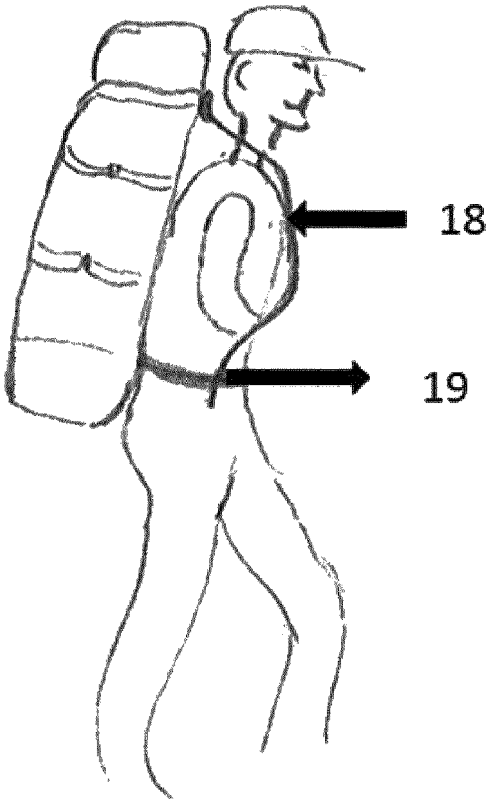

| | | | | | |
|---|---|---|---|---|---|
| 4,154,381 | A * | 5/1979 | Zufich | A45F 3/08 | 224/262 |
| 4,179,053 | A * | 12/1979 | Figura | A45F 3/08 | 135/120.3 |
| 4,431,121 | A * | 2/1984 | Bensette | A01M 31/00 | 224/153 |
| 4,892,240 | A * | 1/1990 | Bell | A45F 3/08 | 224/153 |
| 5,586,699 | A * | 12/1996 | Heisler | A45F 3/047 | 224/259 |
| 6,796,468 | B1 * | 9/2004 | Nideborn | A45F 5/00 | 224/201 |
| 2004/0140332 | A1 * | 7/2004 | Blood, Jr. | A45F 4/04 | 224/156 |
| 2011/0108595 | A1 | 5/2011 | Hoag | | |
| 2016/0000212 | A1 * | 1/2016 | Lee | A45F 3/08 | 224/265 |

OTHER PUBLICATIONS

International Preliminary Report on Patentability issued in counterpart PCT Application No. PCT/EP2016/061572 dated Dec. 7, 2017 (eight (8) pages).

* cited by examiner

CARRIER FRAME FOR A RUCKSACK OR EQUIVALENT

CROSS REFERENCE TO RELATED APPLICATIONS

This is a 371 national stage patent application, which claims priority to PCT International Patent Application No. PCT/EP2016/061572, filed May 23, 2016, and titled CARRIER FRAME FOR A RUCKSACK OR EQUIVALENT, which claims priority to Swedish Patent Application Number 1530075-9, filed May 25, 2015; the disclosures of which are incorporated herein by reference in their entireties.

TECHNICAL FIELD

The present invention relates to a carrier frame for rucksacks or equivalent which is based on a structure where the carrier frame is partially positioned in front of the body and utilises the frame's moment and load-relieving aspects to reduce the load on the shoulders and to avoid incorrect loading of the back.

TECHNICAL BACKGROUND

Carrying heavy rucksacks has always usually involved incorrect loading of the back and shoulders. Over the years the development of rucksacks for heavier load bearing has been aimed at reducing the load on the back and shoulders. The founder of Fjällräven raised the rucksack with a carrier frame behind the back in order to displace the centre of gravity towards the body's vertical line and by raising the rucksack the centre of gravity was raised, resulting in a certain degree of instability. The so-called Softpacks with an integrated frame system were aimed at getting the rucksack as close to the body as possible and to displace the centre of gravity to the vertical line of the body and at the same time to keep the centre of gravity down. More of the weight was also able to be distributed down onto the hips with the aid of a waist band so as to reduce the pressure on the back and shoulders. However, a large part of the weight was still borne over the shoulders. The weight on the hips was caused by the rucksack pulling down the waist band from the hips through its connection at the bottom part of the rucksack. The solution does not therefore allow an even distribution of the load around the hip section.

When carrying a rucksack a person had to lean forwards, with the weight over the shoulders, whereby the spine was bent to achieve balance. The weight over the shoulders helps to bend the spine and the spine takes up the occurring moment forces to create balance in the assembly (carrier and rucksack). The back is strained, in particular lower down in the lumbar spine which takes up greater forces during bending of the back.

There are patents for carrier frames with frame structures which are partially at the front of the body for carrying children on the shoulders (for example European Patent Application 81303333.9 from 1981). The main purpose of these carrier frames is to prevent the child from falling off the shoulders. The child sits on the shoulders with support for the child's back and the child's weight is borne on the shoulders without any intention of distributing the weight down to the hips. The sole function of the carrier frame is to prevent the child falling backwards, not to reduce the load on the shoulders.

The problem with current conventional rucksack solutions continues to be painful shoulders and backs with heavy loads over a longer time.

The cause of the problem with the current rucksack solution is a combination of 1. the weight or load relief borne on the shoulders and
2. the forward inclination of the upper body with a bent spine in order to achieve balance
3. the rucksack's pulling behaviour on the soft hip belt resulting in the load relief being concentrated over both iliac crests and not around the entire hip area of the body.

The weight on the shoulders means that it is easier to bend the back forwards in order the carry the rucksack in a balanced manner. In this way a large load is taken up by the shoulders and the lower regions of the back, which results in tiredness or pain in the back, particularly in the lumbar spine which takes up the moment to keep the body in balance.

Purpose of the Invention

A particular aim of the invention is to reduce the loading problem when carrying a rucksack or equivalent in cases where the load increases or when it is carried over a long period of time. The task of the invention is to provide a carrier frame for a rucksack or equivalent which greatly reduces or eliminates aching in the shoulders and back.

A particular aim of the invention is also to allow the carrying of a rucksack or equivalent with an upright and inwardly curved back position.

A further particular aim of the invention is to optimise the weight distribution over the chest and hip/pelvis region depending on carrying on ascending gradients, level ground and descending gradients.

Another particular aim of the invention is to evenly distribute a load around the hip region of the body.

Another aim of the invention is a device to facilitate the putting on or taking off of the rucksack assembly (rucksack and carrier frame).

A further aim of the invention is a device which assures fixation of the hip belt round the hip irrespective of carrying uphill or downhill.

SUMMARY OF THE INVENTION

The invention relates to a carrier frame for a load in the form of a rucksack or equivalent, or other load, comprising a hip frame which is more rigid in the vertical direction than in the horizontal direction and a pair of chest frames. The hip frame is designed to be applied around the user's hips in order to transfer loads to the carrier's hip region.

The chest frames extend from the hip frame upwards in front of the user's body and are fully or partially in contact with the user's chest area, below the user's collar bone but above the user's waist. The chest frames are each provided with a chest plate in order to distribute the pressure over a greater area when applied to the user's chest area and to reduce the pressure per unit area on the user's chest.

The chest frames also extend above the user's shoulders essentially without being in contact with them. The chest frames also extend behind the user's head and are flexibly connected to each other at a position behind and/or above the nape of the user's neck. The chest frames are connected to the hip frame at respective side parts of the hip frame, essentially directly by the user's iliac crests.

By "essentially without being in contact" is meant that less than 50 N is transferred, preferably less than 10 N, less than 1 N or less than 0.1 N is transferred to the user's shoulders.

By "essentially outside the iliac crests" is meant within a radius of 5 cm from the iliac crest, preferably within a radius of 3 cm or within a radius of 1 cm.

The connections between the chest frames and the hip frame can comprise an articulated device whereby the chest frames are movable relative to the hip frame.

LIST OF FIGURES

The following figures are used in the description of the invention set out below. FIGS. 1-8 illustrate the functional elements of the invention and its use which allows carrying with a straight and inwardly curved back.

FIG. 1 Carrying on level ground.

Figure 2:
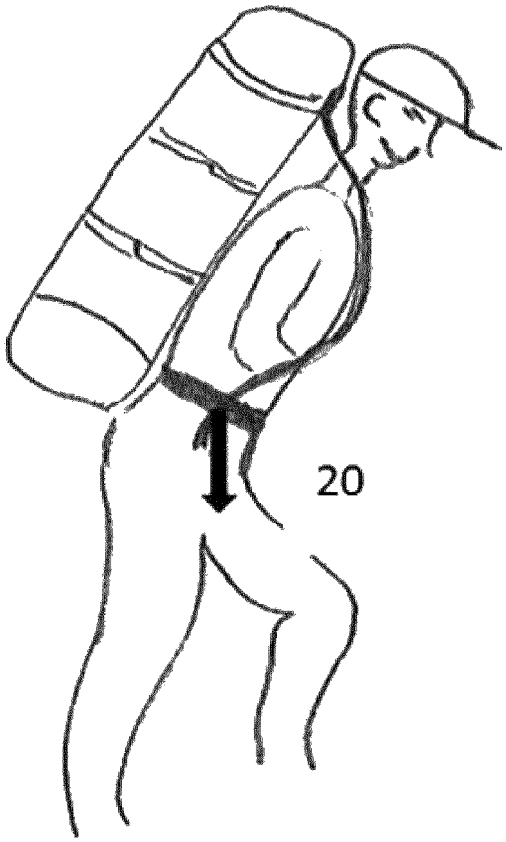

FIG. 2 Carrying on an ascending gradient.

Figure 3:
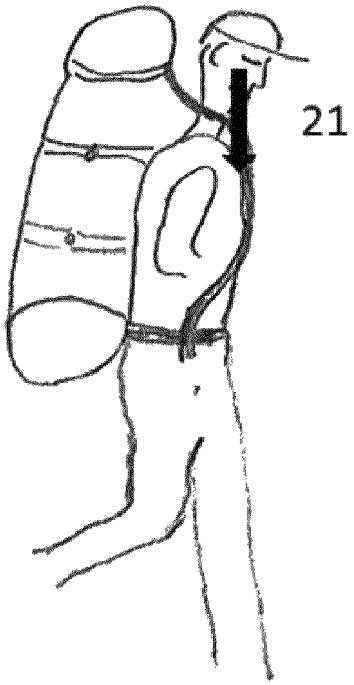

FIG. 3 Carrying on a descending gradient.

Figure 4:
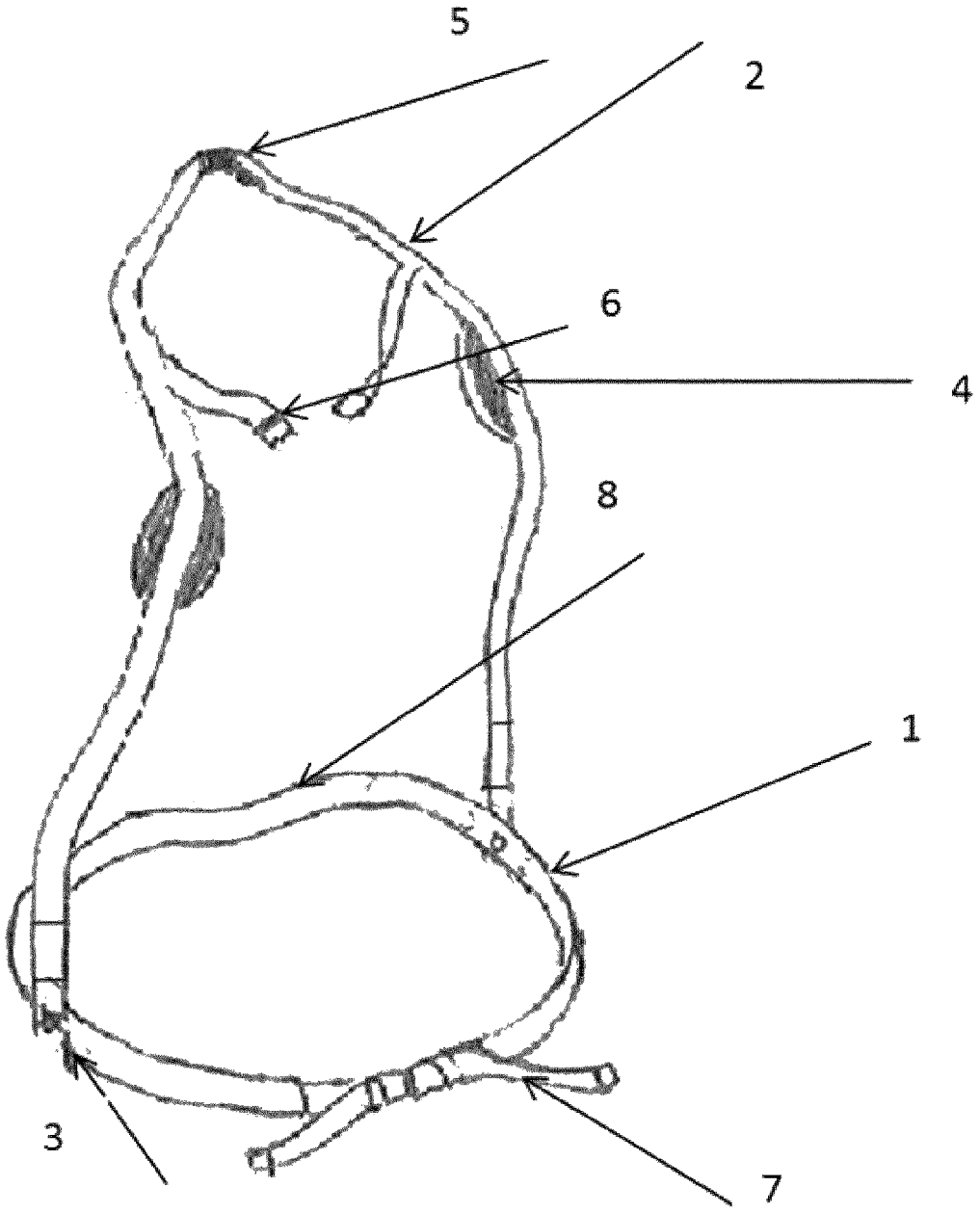

FIG. 4 Perspective view of the carrier frame.

Figure 5:
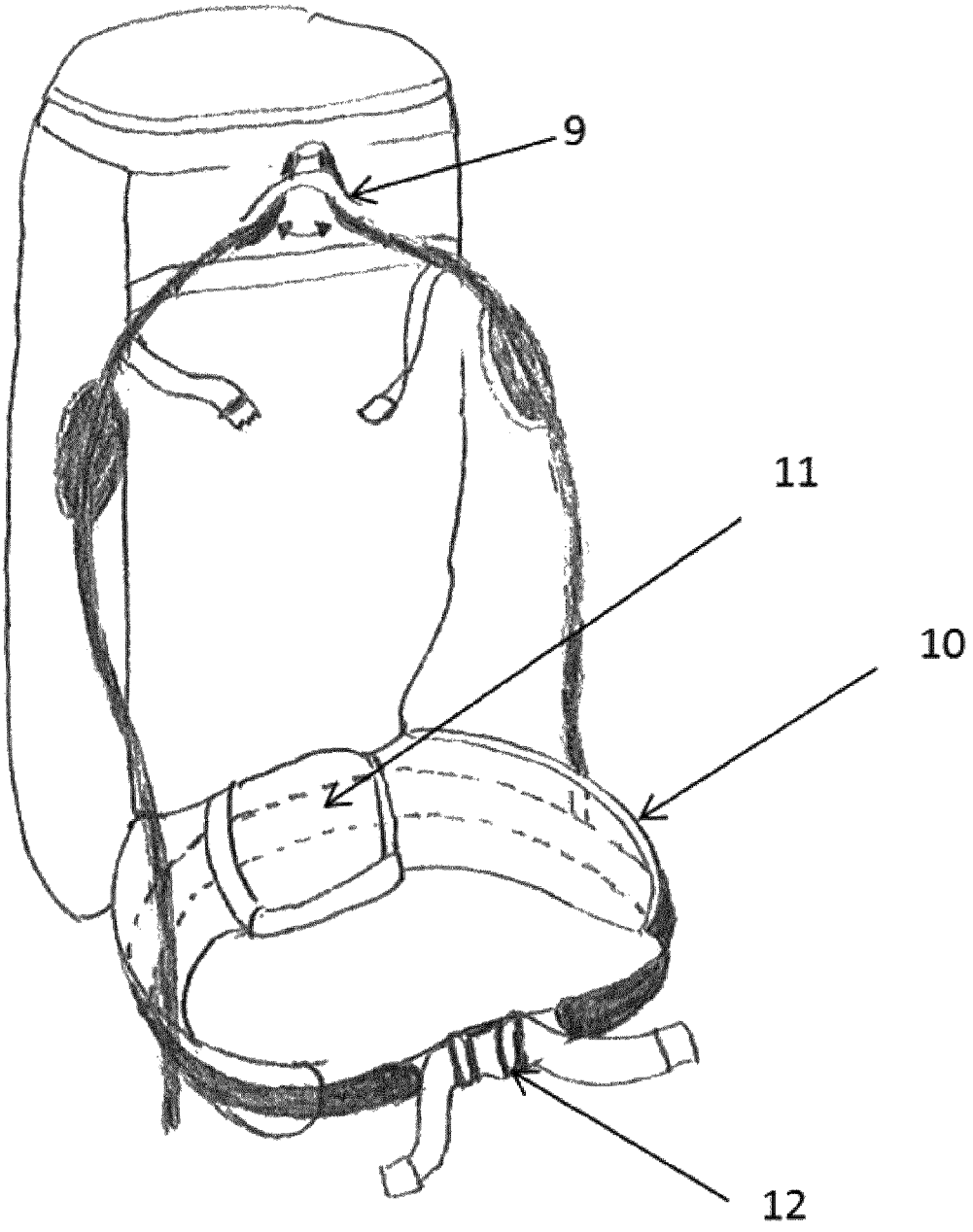

FIG. 5 Carrier frame with rucksack.

Figure 6:
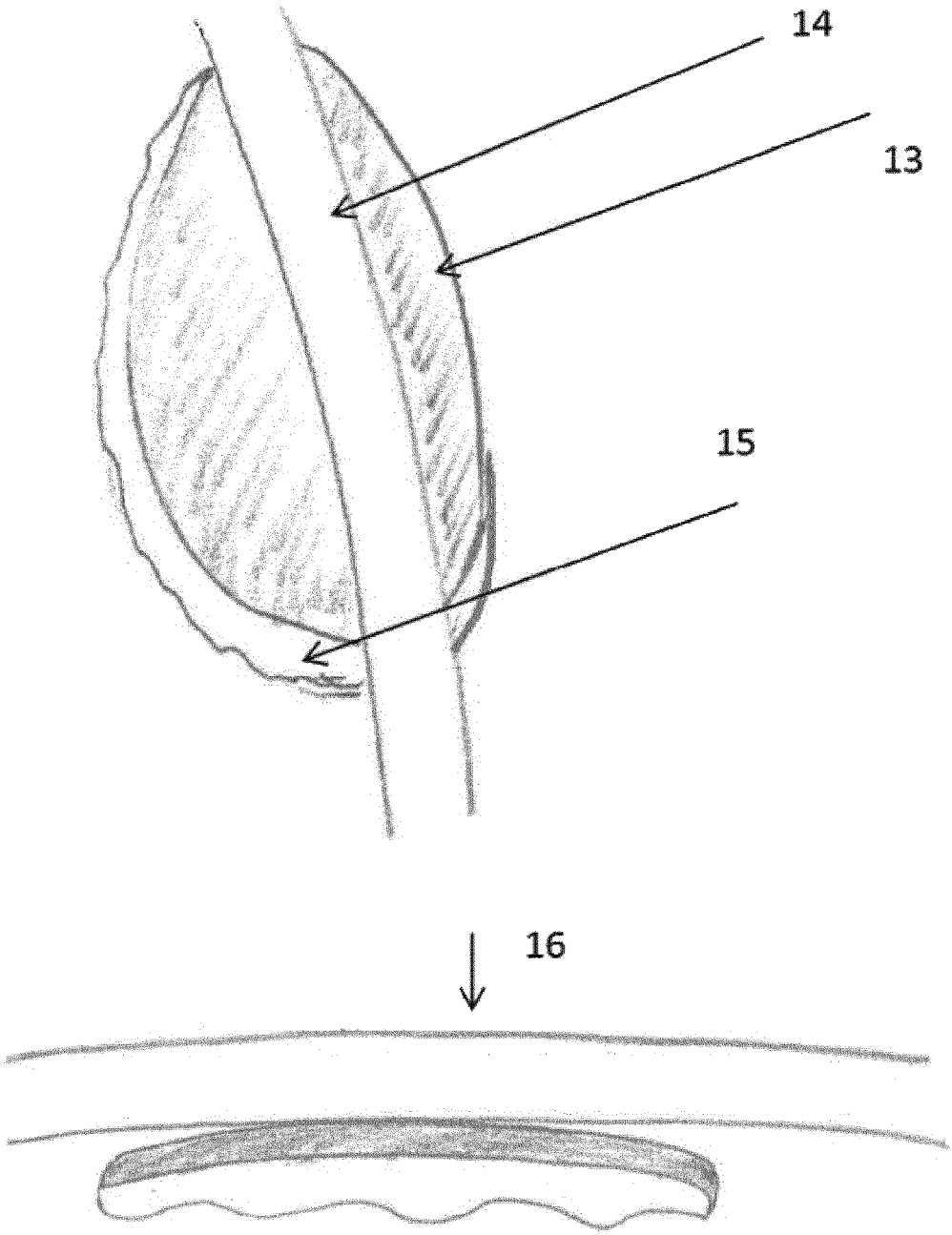

FIG. 6 Chest load reduction.

Figure 7:
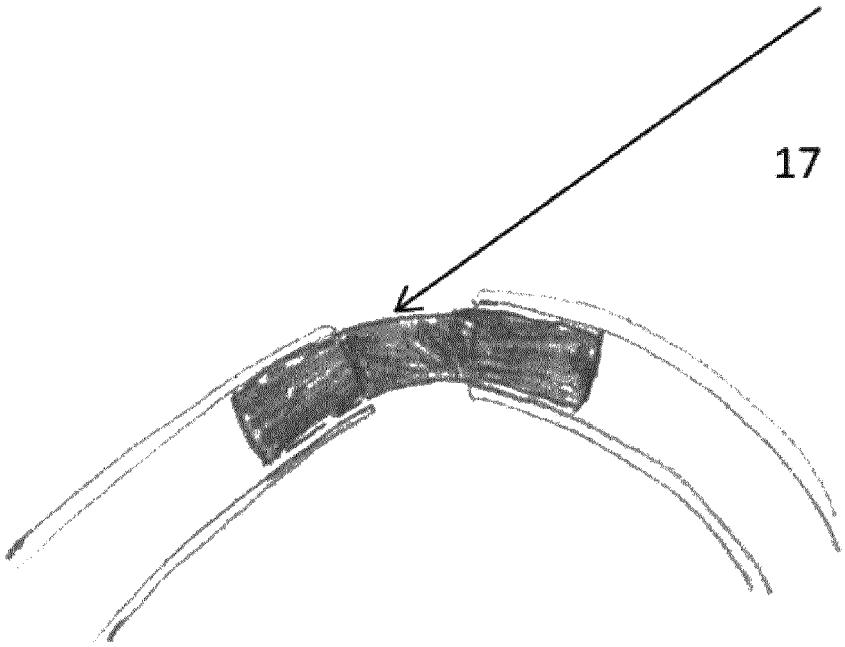

FIG. 7 Top connection of the chest frame.

Figure 8:
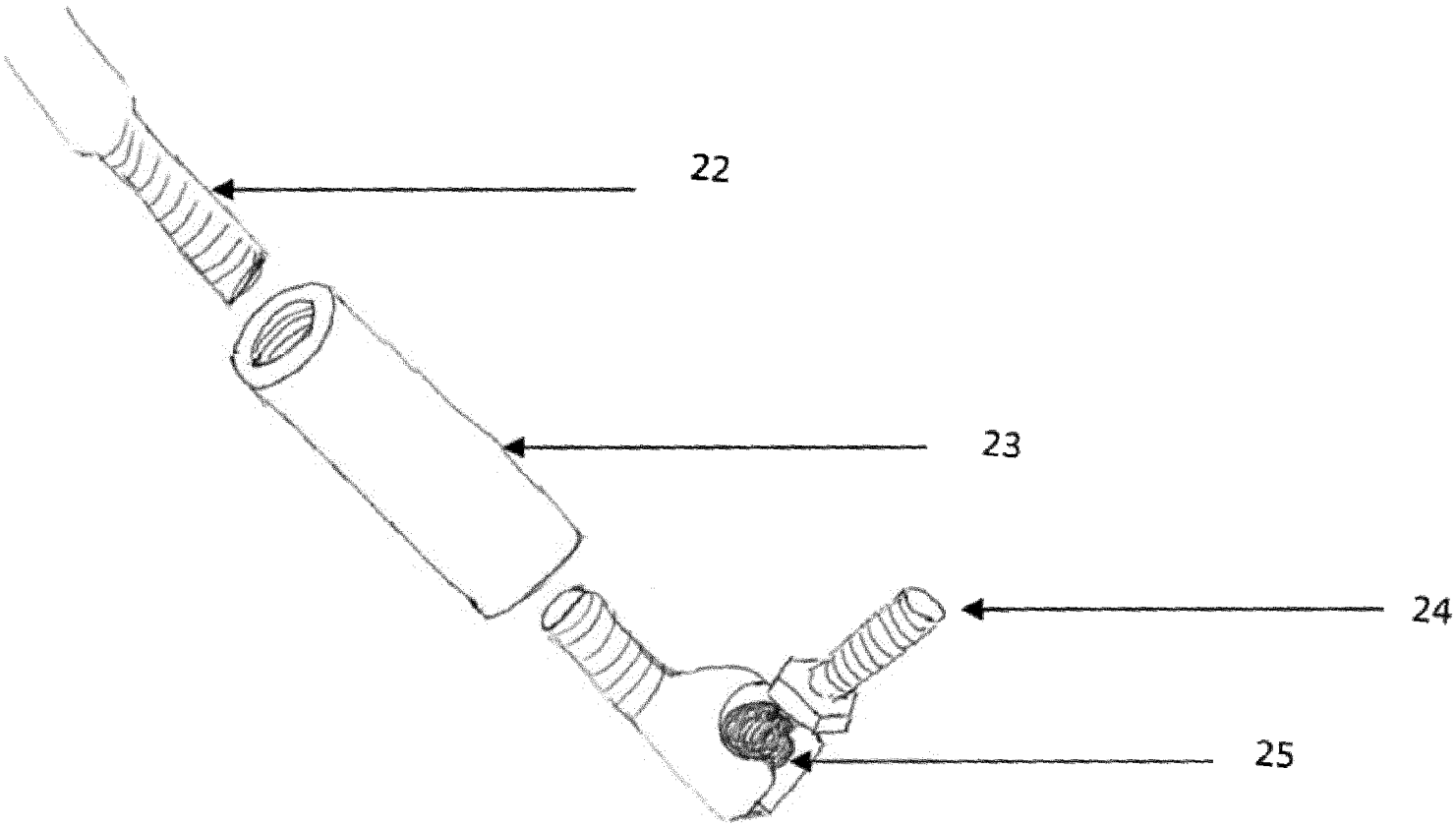

FIG. 8 Fastening of the carrier frame to the hip frame with adjustable device.

Figure 9:
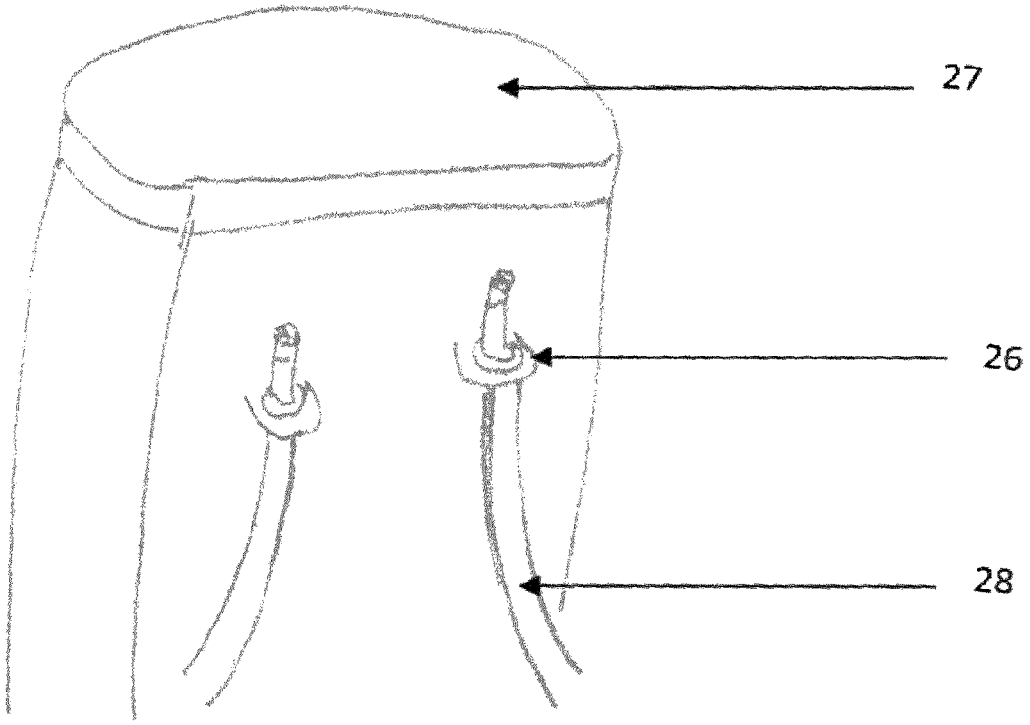

FIG. 9 Fastening of the carrier frame to a load, for example a rucksack.

Figure 10:
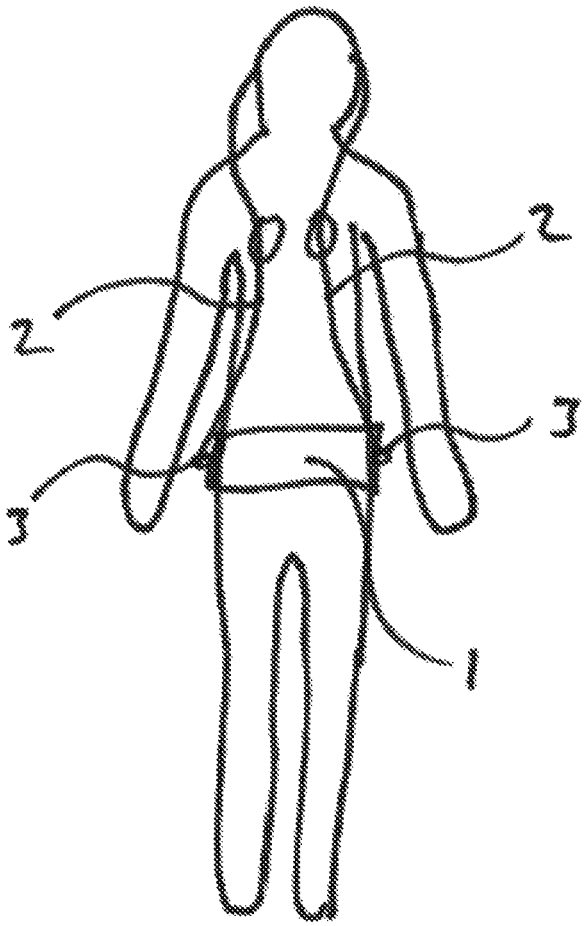

FIG. 10 A front profile view of the user illustrating connections.

DESCRIPTION

The present invention relates to a device for carrying a rucksack or equivalent comprising (1) a circular shaped hip frame (1) which is vertically rigid and horizontally slightly bendable with a lumbar support (8) in aluminium and/or together with another material with equivalent strength properties connected thereto, (2) two rigid chest frames for force transmission of a heavier rucksack or equivalent vertically connected on each side to the hip section (3) in a movable articulated (24) and adjustable position-orientated connection (22) in a hip frame, extending in front of the body contacting a chest area located below the collar bone but above the waist with pressure-relieving devices (4) and further extending over and without contacting the shoulders and extending above the shoulders and behind the head where they are connected flexibly to each other by means of a bushing made of rubber or a rubber-like material, alternatively a joint which forms a (5) suspension device for the rucksack or equivalent.

The invention is initially described with illustrations of how it is used. Carrying and pressure-relief on the body varies in relation to different gradients.

FIG. 1 illustrates carrying on level ground. The design of the carrier frame utilises the moment and forces that occur when a rucksack is suspended on the frame behind the head and (i) the fact that no weight is supported over the shoulders, (ii) the fact that the chest frames vertically press the chest (18) back (iii) at the same time as the chest frame pulls (19) the hip frame vertically forwards which pushes out the hips forcing the spine into an upright posture with the back curved inwards.

Bending forward for balance must therefore take place via the hips.

The body is bent forward slightly by the hip and the back is straight with an inward curve. The absolute majority of the weight is applied to the hips via the chest frame and an insignificant portion over the chest. The horizontal position of the chest frames in relation to the hip frame can be varied so that optimum weight distribution around the entire hip area is achieved when the chest frames are connected to the hip frame directly at both iliac crests.

FIG. 2 shows how carrying on steeper ascending gradients makes the body bend forwards more in order to achieve balance. All the weight (20) is discharged onto the hips. The vertical distance between the rucksack suspension device and the hips is reduced by leaning forwards more whereby the chest frame forces down the hip frame. With an adjustable hip connection (23) (see FIG. 8) the distance can be corrected by lowering the chest frame in relation to the hip frame.

Carrying on steep descending gradients in accordance with FIG. 3 causes the upper body to naturally adopt an upright position in order to achieve balance. The back adopts a natural and straight posture with an inward curve. The chest part of the body is pushed forward and the chest frame devices according to (3) (see FIG. 4) and (16) (see FIG. 6) for load relieving on the chest are utilised for vertically taking the rucksack's weight. On steep ascending gradients a larger part (4) and (21) of the weight is supported via the chest frame load relieving device and a smaller part via the hips. The weight relationship between the chest and hip frame can be changed depending on the load and the descending gradient.

Carrying on different gradients allows different angles between the hip frame and chest frame through an articulated device (3) and (25) mounted in the hip frame for fixing the hip frame in the same position during movement with optimum loading of the hips in the case of leaning forwards, backwards and/or sideways.

The carrier frame illustrated in FIG. 4 comprises a fully or partially circular hip frame (1) with a slightly inwardly bent back section (8) made of a hard but thin quadrilateral material with an invariable oblong cross-section (aluminium, hard plastic or equivalent material) such that the frame is horizontally but not vertically bendable so that the load can be evenly distributed over the hip frame. In the hip frame two chest frames (2) are connected, one on each side of the hip frame with a moveable, articulated device (3) and (25) for adjustable position orientation of the connection. The chest frames extend forwards (in front of the body) so as to come into contact with the chest via two chest plates (4), the purpose of which is to prevent discomfort or pain in the chest area in connection with pressure and weight being supported on the chest. The chest frames also extend over the shoulders, without coming into contact with them, and to the back of the head where the two chest frames are connected to each other by means of a connection (5) that is movable in relation to each chest frame. The purpose of a chest strap (6) is to stabilise and attach the frame to the body. The purpose of a waist strap (7) is to attach the hip frame over the hips and upper pelvic region so that the load is supported evenly around the body.

A conventional softpack-type rucksack can be advantageously used together with the carrier frame. A rucksack connected to the carrier frame is illustrated in FIG. 5. The rucksack is suspended on the connection point of the chest frames (9) whereby all the load is transferred to the chest frames. Other points of attachment of the rucksack on the carrier frame are constituted by straps which serve the purpose of stabilising the rucksack close to the body and the carrier frame. The rucksack's shoulder straps are removed and the hip belt (10) can simply be attached to the hip frame with straps or by way of through bolts, washers and nuts. The hip frame is attached at the back of the rucksack's lumbar plate (11) and at the hip belt (10). The hip belt is attached to the hip frame and has a protective effect against the pressure applied around the hips. The closing device (12) on the rucksack's hip belt can be advantageously used in place of the waist strap of the carrier frame.

Position orientation of the chest frames in relation to the frame takes place by means of a through nut with a rotatable head which is applied in any of the holes in the hip or chest frame in order to fit the carrier (3), (see FIG. 4).

As the chest is utilised to take up the moment force which the rucksack generates, there are devices in the form of two chest plates (4) and (13) formed and attached (16) to the two chest frames (2). Supporting of the load on a large and soft (15) surface prevents pain or damage to the chest region in the case of large loads. A soft surface can be formed by an air cushion, gel or other soft material which is deformable under loading.

The top connection of the chest frames is constituted by a flexible component, such as a rubber bushing (17) or a spring, which is inserted into the hollow space of each chest frame. The flexibility allows the chest frames to be screwed in or out for optimum carrying with the aid of the chest strap. The bushing allows the carrier frames to be twisted out so that putting on or taking off the rucksack assembly (carrier frame and rucksack) is made considerably easier compared with a conventional rucksack with loose shoulder straps. The top of the carrier frame can also be advantageously mounted directly on a load, for example a rucksack, wherein the load (27) constitutes the connection between the two chest straps (28) and which through the connection points (26) can take up all or part of the weight of the load.

The connection at the top of the chest frames can be provided with a vertically adjustable suspension device for different carriers' preferences in relation to how high the rucksack should be connected to the carrier frame.

The chest frames can be designed in a telescopic manner with vertically fixable prolongation or shortening of the length of the chest frames in front of the chest so that the carrier frame fits different body heights.

The chest plates can be provided with cushions of gel, foam or air of selectable thickness so that the chest plates fit different body profiles.

The hip and chest frames can be provided with a flexibly adjustable connection which allows independent movement of the fastening between the hip frame and chest frame in the vertical and/or horizontal direction without the hip frame causing discomfort. Such a device can advantageously be formed by a movable articulated device (25) which at one end is attached to the hip frame by a through articulated device (24) with locking washers and at the other end is attached to the chest frames (22) with an internally threaded tube (23).

One or two similar articulated joints may be used to connect the chest frames to each other behind the user's neck or head.

The chest frame design can be realised by an internally threaded tube together with an externally threaded lower part (22) of the chest frame, which makes it possible to prolong or shorten the length of the chest frame by screwing the chest frames into and/or out of the hip frame in the internally threaded tube.

As another option, the adjusting device may comprise a pair of telescopingly slidable parts and a locking device for releasably locking the slidable parts relative each other.

The locking device may comprise a pin which is insertable through holes in the respective part, or through a wedge member which provides a friction based connection of the parts.

The chest frames may be connectable to each other in an area between the user's collar bone and the user's waist. Such connection may be permanent, i.e. the frames are joined to each other. Alternatively, the connection may be releasable, e.g. achieved by means of a buckle or snap lock.

Production of the hip frame is advantageously carried out using a rigid substance such as, for example, aluminium or hard plastic which is fully or partially covered with a composite material, for example, carbon fibre, which is hardened onto the substance. The material can be 10-150 mm in height and 1-5 mm wide, depending on the number of composite layers that are applied. The chest frames are advantageously made of a round, hollow, workable material with a diameter of 5-30 mm, for example a plastic tube or aluminium which can be shaped to a carrier's body with or without heat. The workable material is covered with one or more layers of a composite material, for example, carbon fibre, which is hardened so that the chest frame achieves a rigidity that withstands the force transmission of a heavy weight from the load to the hip frame without breaking or bending so that the carrying method is hindered. The chest frame is attached to the hip frame by means of an articulated device which is applied through a hole in the hip frame so that the two frames are in close contact with each other. The chest frames are most advantageously connected to each other with a rubber bushing or equivalent that is pushed into the hollow space of each chest frame so that it is firmly fastened in the respective hollow spaces and has a piece in between which allows movement between each chest frame. Alternatively the chest frames can be attached directly to the load behind the head so that movement is provided between the two chest frames (see FIG. 9). Fastening can take place, for example, in that the chest frames pass through one or more holes in the load and are fixed with nuts or suchlike which are threaded onto a externally threaded chest frame and locking washer applied on both sides of the fastening point of the load. The chest plates are made of any hard material which is covered with a composite material which is hardened together with the chest frame or any other fastening method, such as screwing, welding or gluing. The chest plate padding can be produced by means of polystyrene, gel or any other padding material which is attached mechanically or with any adhesive-like material.

FIG. 10 illustrates a front profile view of the user wearing the hip frame illustrating the connections. As shown in FIG. 10, the circular hip frame (1) includes two chest frames (2) connected on each side with a moveable, articulated device (3). The moveable articulated device may also be known as one or more connectors. As illustrated in FIG. 10, each connector is configured to be positioned right outside a respective one of the user's iliac crests at a horizontal plane of the iliac crest. The connector may also be positioned outside of the iliac crest in a lateral direction of the user.

The invention claimed is:

1. Carrier frame for a rucksack, comprising:

a hip frame, which is more rigid in a vertical direction than in a horizontal direction, configured for application around a user's hips in order to transfer loads to the carrier's hip region, a pair of chest frames, wherein the chest frames extend from the hip frame upwards in front of the user's body and are fully or partially in contact with the user's chest area, below the user's collar bone but above the user's waist, wherein the chest frames further extend above the user's shoulders without being in contact with them, and wherein the chest frames further extend behind the user's head and are flexibly connected allowing resilient relative movement between the chest frames to each other at a load or load-suspension device at a position behind the nape of the user's neck, wherein the hip frame comprises connectors positioned at respective side parts of the hip frame, wherein the connectors are connected to the chest frames at respective side parts of the hip frame, each connector being configured to be positioned right outside a respective one of the user's iliac crests at a horizontal plane of the iliac crest.

2. Carrier frame according to claim 1, wherein the chest frames are each provided with a chest plate to distribute the pressure over a greater area and to reduce the pressure on the user's chest.

3. Carrier frame according to claim 1, wherein the chest frames are connected to the hip frame via a movable articulated device, which is attached in a hole through the hip frame and/or respective chest frame so that a connection point can be vertically and/or horizontally adjusted.

4. Carrier frame according to claim 1, wherein at least one of the chest frames comprises a length adjusting device for adjusting the length of the chest frame.

5. The carrier frame as claimed in claim 4, wherein the adjusting device comprises an internally threaded sleeve and an externally threaded part so that the length of the chest frame can be changed by screwing the sleeve in or out on the externally threaded part.

6. The carrier frame as claimed in claim 4, wherein the adjusting device comprises an pair of telescopingly slidable parts and a locking device for releasably locking the slidable parts relative each other.

7. Carrier frame according to claims 1, wherein the chest frames extending back over the shoulders are flexibly connected to each other behind the carrier's head.

8. The carrier frame as claimed in claim 7, wherein the chest frames are connected to each other by a resiliently flexible bushing, mounted in the respective chest frame or with one or more joints so that the chest frames can assume different angles in relation to a vertical plane.

9. The carrier frame as claimed in claim 7, wherein the chest frames are connected to each other by at least one articulated joint.

10. Carrier frame according to claim 1, wherein the chest frames extending back over the shoulders are flexibly connected to each other at the back of the carrier's head via a flexible part of a load supported by the frame.

11. Carrier frame according to claim 1, wherein the rear side of the hip frame has a lumbar support which is accomplished by a straighter or slightly inwardly bent back section on the rear of the hip frame and/or through an additional pad for stronger projection of the hip frame into the curve of the back.

12. The carrier frame as claimed in claim 1, wherein the chest frames are connectable to each other in an area between the user's collar bone and the user's waist.

13. Rucksack provided with a carrier frame according to claim 1.

14. The carrier frame as claimed in claim 1, wherein the hip frame together with the chest frame provide a torque due to a horizontal force backwards being generated from a frontside of the chest frame and a forward force pulled from the hip frame when the chest frame is loaded behind the neck.

* * * * *